US007900731B2

(12) United States Patent
McKinzie

(10) Patent No.: US 7,900,731 B2
(45) Date of Patent: Mar. 8, 2011

(54) SHOE WITH RETRACTABLE MOTORIZED WHEELS

(76) Inventor: Bradley K. McKinzie, Spartanburg, SC (US)

( * ) Notice: Subject to any disclaimer, the term of this patent is extended or adjusted under 35 U.S.C. 154(b) by 562 days.

(21) Appl. No.: 11/983,945

(22) Filed: Nov. 13, 2007

(65) Prior Publication Data

US 2009/0120705 A1 May 14, 2009

(51) Int. Cl.
*A63C 17/04* (2006.01)
*A63C 17/12* (2006.01)

(52) U.S. Cl. ..... 180/181; 280/11.27

(58) Field of Classification Search ..... 280/11.19, 280/11.231, 809, 11.27, 11.25, 11.232; 180/65.1, 180/65.51, 181
See application file for complete search history.

(56) References Cited

U.S. PATENT DOCUMENTS

| | | | | | |
|---|---|---|---|---|---|
| 2,284,344 | A | * | 5/1942 | Russell | 180/315 |
| 2,290,250 | A | * | 7/1942 | Russell | 180/315 |
| 2,857,008 | A | * | 10/1958 | Pirrello | 180/181 |
| 3,884,485 | A | | 5/1975 | Wälle | 280/11.1 |
| 3,983,643 | A | | 10/1976 | Schreyer et al. | 36/115 |
| 4,508,187 | A | | 4/1985 | Wenzel | 180/181 |
| 4,928,982 | A | | 5/1990 | Logan | 280/11.22 |
| 5,020,621 | A | | 6/1991 | Martin | 180/181 |
| 5,236,058 | A | | 8/1993 | Yamet et al. | 180/181 |
| 5,372,534 | A | * | 12/1994 | Levy et al. | 446/457 |
| 5,487,441 | A | | 1/1996 | Endo et al. | 180/181 |
| 5,785,327 | A | * | 7/1998 | Gallant | 280/11.27 |
| 5,797,609 | A | | 8/1998 | Fichepain | 280/11.19 |
| 5,829,543 | A | * | 11/1998 | Diaz | 180/181 |
| 6,050,357 | A | * | 4/2000 | Staelin et al. | 180/65.1 |
| 6,059,062 | A | * | 5/2000 | Staelin et al. | 180/181 |
| 6,109,624 | A | * | 8/2000 | Message et al. | 280/11.223 |
| 6,247,708 | B1 | * | 6/2001 | Hsu | 280/11.223 |
| 6,343,800 | B2 | | 2/2002 | Clementi | 280/11.233 |
| 6,386,555 | B1 | | 5/2002 | Kao | 280/7.13 |
| 6,386,556 | B1 | | 5/2002 | Yeh | 280/11.223 |
| 6,394,468 | B1 | | 5/2002 | Chiang et al. | 280/11.223 |
| 6,402,162 | B1 | | 6/2002 | Chiang | 280/11.233 |
| 6,406,038 | B2 | | 6/2002 | Adams | 280/11.24 |
| 6,428,050 | B1 | * | 8/2002 | Brandley et al. | 280/809 |
| 6,523,836 | B1 | | 2/2003 | Chang et al. | 280/11.223 |
| 6,536,785 | B2 | | 3/2003 | Lee | 280/11.27 |
| 6,572,120 | B2 | * | 6/2003 | Chang | 280/11.233 |
| 6,604,593 | B1 | | 8/2003 | Mullet | 180/181 |
| 6,626,442 | B2 | * | 9/2003 | Pahis | 280/11.115 |
| 6,629,698 | B2 | | 10/2003 | Chu | 280/11.19 |
| 6,805,363 | B2 | | 10/2004 | Hernandez | 280/11.19 |
| 6,926,289 | B2 | | 8/2005 | Wang | 280/7.13 |
| 7,036,829 | B2 | | 5/2006 | Maxwell et al. | 280/11.223 |
| 7,165,774 | B2 | | 1/2007 | Adams | 280/11.221 |
| 7,204,330 | B1 | * | 4/2007 | Lauren | 180/181 |

(Continued)

*Primary Examiner* — J. Allen Shriver, II
*Assistant Examiner* — Bridget Avery
(74) *Attorney, Agent, or Firm* — Timothy J. Monahan; Monahan & Moses, LLC

(57) ABSTRACT

A pair of shoes is provided having retractable motorized wheels. Each of the shoes has an upper, a sole, and first and second wheels mounted on the sole and movable from a retracted to an extended position. When the wheels are in an extended position, at least one wheel of one of the shoes engages a battery-powered, DC motor mounted on the shoe. The motor is controlled by a hand-held throttle. A latching mechanism engages to secure the wheels in the desired position. The shoes may be used for skating, with and without power assistance, with the wheels in an extended position, and may be used for walking, with the wheels in a retracted position.

20 Claims, 4 Drawing Sheets

U.S. PATENT DOCUMENTS

| | | | | |
|---|---|---|---|---|
| 7,383,908 | B2 * | 6/2008 | Tuli | 180/181 |
| 2003/0102642 | A1 * | 6/2003 | Wang | 280/11.233 |
| 2005/0046139 | A1 * | 3/2005 | Guan | 280/221 |
| 2005/0082099 | A1 * | 4/2005 | Tuli | 180/181 |
| 2006/0027409 | A1 * | 2/2006 | Adams et al. | 180/181 |
| 2008/0217084 | A1 * | 9/2008 | Tuli | 180/181 |

* cited by examiner

FIG. —4—

SHOE WITH RETRACTABLE MOTORIZED WHEELS

BACKGROUND OF THE INVENTION

This invention is directed to a shoe having motorized wheels, wherein the wheels may be retracted to provide a flat surface for walking.

Various designs of multifunctional footwear having retractable wheels are disclosed in the patent literature. The footwear is useful both for roller-skating and walking, depending upon whether the wheels are in an extended or retracted position. For example, the footwear may be characterized as a shoe that can be converted to a roller skate, or vice versa, a roller skate that can be converted to a shoe. Typically, each item of footwear is provided with a front axle and a rear axle, with one or two wheels per axle.

In U.S. Pat. No. 3,884,485, Wälle discloses a collapsible roller skate having wheels mounted on levers. The levers pivot in a thick-platformed roller skate from a retracted position to an extended position.

In U.S. Pat. No. 3,983,643, Schreyer et al. disclose a shoe with retractable wheels that may be used for walking or roller-skating. In one embodiment, the wheels are mounted on levers, so that the levers engage to hold the wheels in an extended position.

A shoe for walking and roller skating is shown in U.S. Pat. No. 6,343,800 issued to Clementi. The wheels retract into the sole for walking. In U.S. Pat. No. 6,386,556, Yeh discloses a roller skate having wheels mounted on levers, which can be retracted into the sole of the skate.

Roller skates having front and back wheel assemblies, which swing in an arc to retract each axle and wheel assembly into the sole of the skate, are disclosed in the following references: U.S. Pat. Nos. 6,402,162 B1; 6,523,836 B1; 6,536,785 B2; 7,036,829 B2.

Multifunctional footwear having a single retractable wheel positioned beneath the heel is shown in Chu, U.S. Pat. No. 6,629,698 B2 and Wang, U.S. Pat. No. 6,926,289 B2.

A shoe having a removable rear wheel is sold under the trademark Heelys®. The shoe is disclosed in U.S. Pat. No. 7,165,744, as well as in the other patents and patent applications of Roger R. Adams cited therein.

Various inventions directed to motorized roller skates and skateboards have been disclosed in the patent literature. For example, in U.S. Pat. No. 5,236,058, Yamet et al. disclose motor driven roller skates. The motor is an internal combustion engine, and an auxiliary wheel is provided to "jump start" the engine by the user skating under his or her own power.

Staelin et al. disclose a powered skates having an electric motor and battery pack mounted on the underside of each skate, in U.S. Pat. No. 6,059,062. A sophisticated control system operates the motor. In one embodiment, a computer receives signals from a sensor located on the skate, and the motor processes the information and controls the operation of the motor.

In U.S. Pat. No. 6,604,593 B1, Mullet discloses powered roller skates having an electric motor mounted on the back of the skates. The batteries for the motor may be carried on the skater's body. The motor may be voice-activated, to allow the skater to control its operation.

Motorized skateboards are shown in U.S. Pat. No. 5,020,621 issued to Martin and U.S. Pat. No. 5,487,441 issued to Endo et al. An electric motor mounted on the underside of the skateboard provides the power.

SUMMARY OF THE INVENTION

The term "shoe" is used herein to encompass footwear having a sole and an upper attached to the sole. The upper is configured to at least partially overlay a person's foot and functions to secure the shoe to a person's foot. The term "shoe" includes footwear that covers the ankle, as well as footwear that does not cover the ankle.

By way of example, the shoe may be a boot, athletic shoe (low-cut or high-cut) or casual-style shoe, any of which may be provided with or without a heel. The upper component of the shoe may be secured to a person's foot by laces, buckles, zipper or straps, or the shoe may be configured to slip on to a person's foot. The shoe may be made of leather, canvas, natural rubber, synthetic rubber of other elastomer, thermoplastic or thermosetting polymer, or any combination of the foregoing. Those skilled in the art will recognize the performance requirements of the shoe, as hereinafter set forth, and select materials and designs to meet those requirements.

The shoe may be provided with a heel that is structurally thicker than the portion of the sole of the shoe positioned under the front of the user's foot. The term "sole" is intended to include such a relatively thick heel. When used to designate the relative location of a feature of the invention, the term "heel" refers to the back of shoe, and the term "toe" refers to the front of the shoe. The terms "front" and "rear" are used herein to designate positions relatively closer to the toe or heel of the shoe, respectively.

A first shoe is provided. The shoe has at least one wheel mounted on the sole, which is movable from a retracted position to an extended position. In the retracted position, the wheel does not extend below the sole of the shoe. In the extended position, the tread of the wheel projects below the sole of the shoe, allowing the user to roll on the wheel. The wheel is mounted on an axle, with the axle aligned approximately 90° relative to the length of the shoe (heel to toe), when the wheel is in the extended position. Rather than a single wheel, two wheels may be mounted on a single axle, such as is commonly done with roller skates.

The wheel is propelled by a battery powered motor. The motor is mounted on the shoe and positioned to engage the wheel, when the wheel is in an extended position. In one embodiment, the motor is mounted on the sole of the shoe, and does not extend below the sole of the shoe. By way of example, the motor can be positioned in the sole of the shoe, beneath the user's instep. The wheel that is propelled by the motor can be positioned in front of or to the rear of the motor, when the motor is positioned in the sole of the shoe.

Various methods may be employed to transmit power from the motor to the wheel, referred to generally as a means to transmit power. For example, power may be transmitted by gears, belt, chain, shaft or flexible cable. In one embodiment, the wheel may have a gear mounted on the axle, which engages a gear on the shaft of the motor, either directly or through one or more idler gears. Those skilled in the art may select the appropriate type of gears (spur, helical, bevel, worm, etc.) and sequences of gears to achieve the desired performance, such as torque, speed, etc.

During operation of the shoe, the user may coast downhill. Accordingly, it is desirable that the wheel powered by the motor (the drive wheel) be allowed free overrun. This may be accomplished by providing a clutch, such as a roller clutch, which transmits torque between a shaft and a wheel/gear in one direction, and allows free overrun in the opposite direction. For example, a Torrington® brand roller clutch may be used. The clutch may be employed in the connection between the shaft of the motor and the drive gear, or in the connection between the wheel and the axle.

The motor may be held in place in a housing. For example, when the motor is positioned in the sole of the shoe, it can be mounted in a housing that holds the motor in place and maintains proper alignment for the motor to engage the wheel, or power transmission means. The housing is designed to allow access to the motor, for repair or replacement, as necessary.

Each shoe may be provided with a second wheel on a second axle, which is also moveable from a retracted position to an extended position. In one embodiment of the invention, the second wheel is not powered by a motor. The second wheel may be free to rotate in any direction. Alternatively, a clutch may be provided so that the second wheel is prevented from turning when the shoe is forced backwards by the user, as when pushing off, but free to turn when the shoe is moving forward.

When two wheels are mounted on the shoe, the wheels may be aligned along the length of the shoe, one wheel in the front of the shoe and one wheel in the rear of the shoe. Either wheel or both wheels may engage the motor. In one embodiment of the invention, only the rear wheel engages the motor and is powered.

Means are provided to mount each wheel so that it can be latched in either a retracted or extended position. The wheels may be independently mounted or may be mounted in such a way that they cooperate to support each other in an engaged position. Examples of methods of mounting retractable wheels both independently and cooperatively are disclosed in the following United States patents: U.S. Pat. Nos. 3,884,485; 3,983,643; 4,928,982; 5,797,609; 6,343,800; 6,386,555 B1; 6,386,556 B1; 6,394,468 B1; 6,402,162 B1; 6,523,836 B1; 6,536,785 B2; 6,629,698 B2; 6,926,289 B2 and 7,036,829 B2.

In one embodiment of the invention, a first wheel is mounted on an end of a first lever, the first lever further having a free end positioned opposite the end where the first wheel is mounted, and a second wheel is mounted on an end of a second lever, the second lever having a free end positioned opposite the end where the second wheel is mounted, and wherein the free ends of the first and second levers engage to lock the wheels in an extended position. The first and second levers are each mounted on a fulcrum secured to the sole of the shoe.

In one embodiment of the invention, the wheel engaging the motor is supported by a carriage, which pivots from a retracted to an extended position in a plane oriented along the length of the shoe and perpendicular to the sole. One side of the carriage may be supported by and pivot relative to the motor housing, and the opposite side of the carriage supports the axle of the wheel. If an idler gear is included in the gear sequence of the means to transmit power, the idler may be supported by the carriage, also.

In one embodiment of the invention, the motor does not engage one of the wheels, and that wheel is supported by a fork, which pivots in a plane oriented along the length of the shoe and perpendicular to the sole.

The shoe is provided with means for latching the first and second wheels in a retracted or extended position. The latching means may be a pin which slides in and out to engage the mechanism for mounting the wheels, for example the carriage or the fork structures. The pins may be connected to a cable, which the user pulls to disengage the pins and thereby allowing the position of the wheels to be changed. Springs can be provided to urge the pins back into engagement with the wheel mounting mechanism, after the wheels are in the desired position and the cable is released.

The present invention includes a second shoe within its scope. The second shoe has at least one wheel that is movable from a retracted to an extended position and means to latch the wheel in a retracted or extended position. The second shoe may be provided with the one or more of the features or combination of features described above with regard to the first shoe. By way of example, the second shoe may have two retractable wheels mounted on two different axles, a motor engaging at least one of the wheels and/or means to latch the wheels in an extended or retracted position. It is important to note, however, that the second shoe may not include a motor, that is, the wheel or wheels of the second shoe may not be motorized. If a shoe does not have a motor mounted on it, then extra weight can be provided in, for example, the sole of the shoe, so that the shoe without the motor weighs approximately the same as the shoe with the motor, thereby making it easier to maintain balance while walking or skating.

The motor is powered by one or more DC batteries. For example, multiple batteries may be provided in a "pack" and connected together in series, in parallel or in a combination of series and parallel connections. The battery pack is preferably rechargeable, and is comprised of one or more rechargeable batteries.

The invention is provided with a means to regulate operation of the motor. In a basic design, a simple "on/off switch" may be provided between the battery and the motor, in a location that is accessible to the user. It will generally be desirable to provide a means to control the operation of the motor, and thus the speed at which the drive wheel turns. The motor controller may be an analog or digital controller. By way of example, the motor controller may be a variable resistor, such as a potentiometer or rheostat, or an electronic speed controller, such as a microcontroller.

DETAILED DESCRIPTION OF THE INVENTION

Without limiting the scope of the invention, a detailed description of the invention and the drawings is hereinafter set forth. All of the United States patents cited in the Specification are hereby incorporated by reference.

Figure 1:
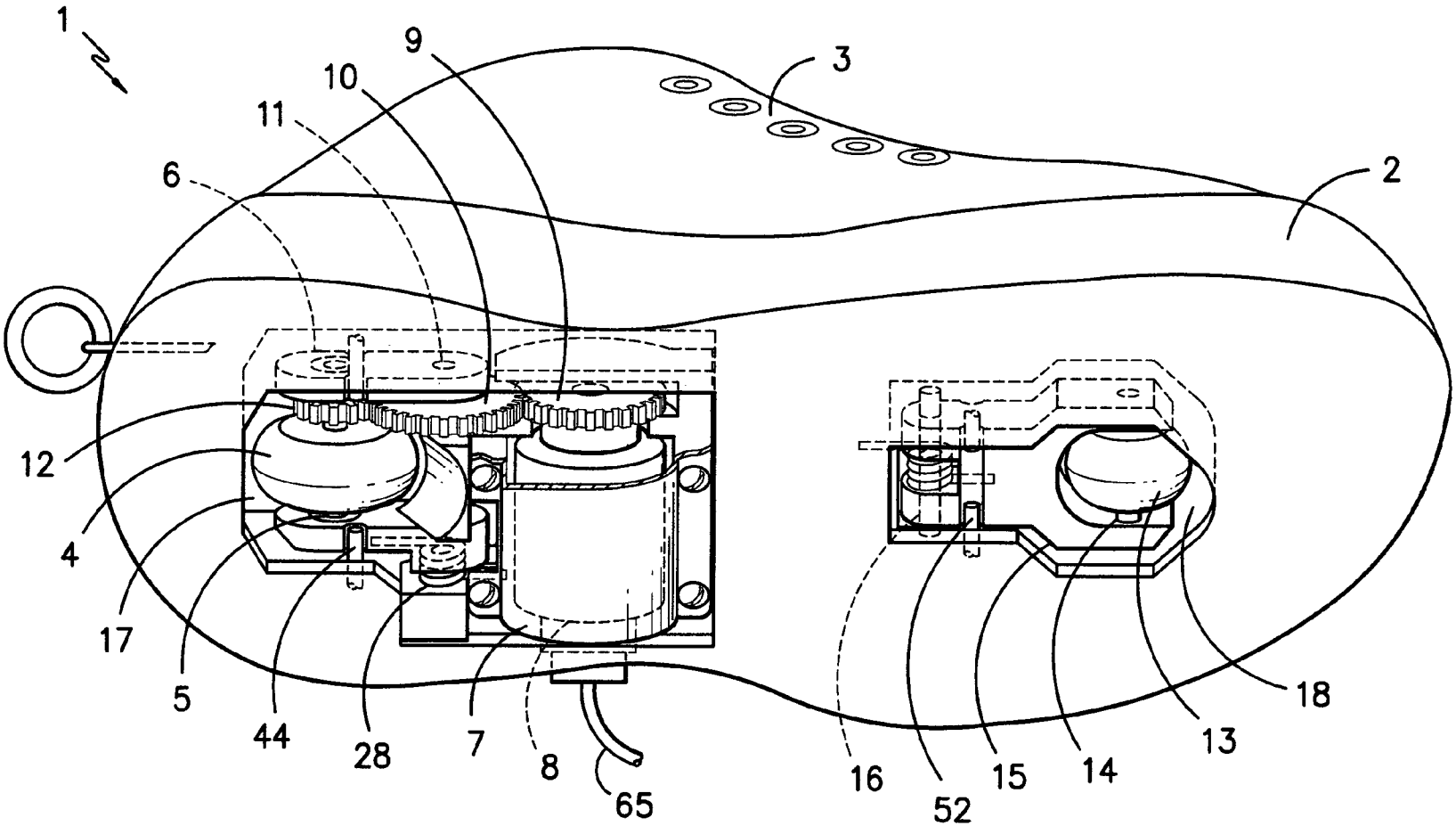
FIG. 1 is perspective view showing the underside of the shoe, with the wheels in an extended position.

Referring to FIG. 1, the underside of shoe 1 is shown with the wheels in the retracted position, as when the shoe is used for walking. Shoe 1 has sole 2 and upper 3. The wheels and motor are mounted on sole 2.

Figure 2:
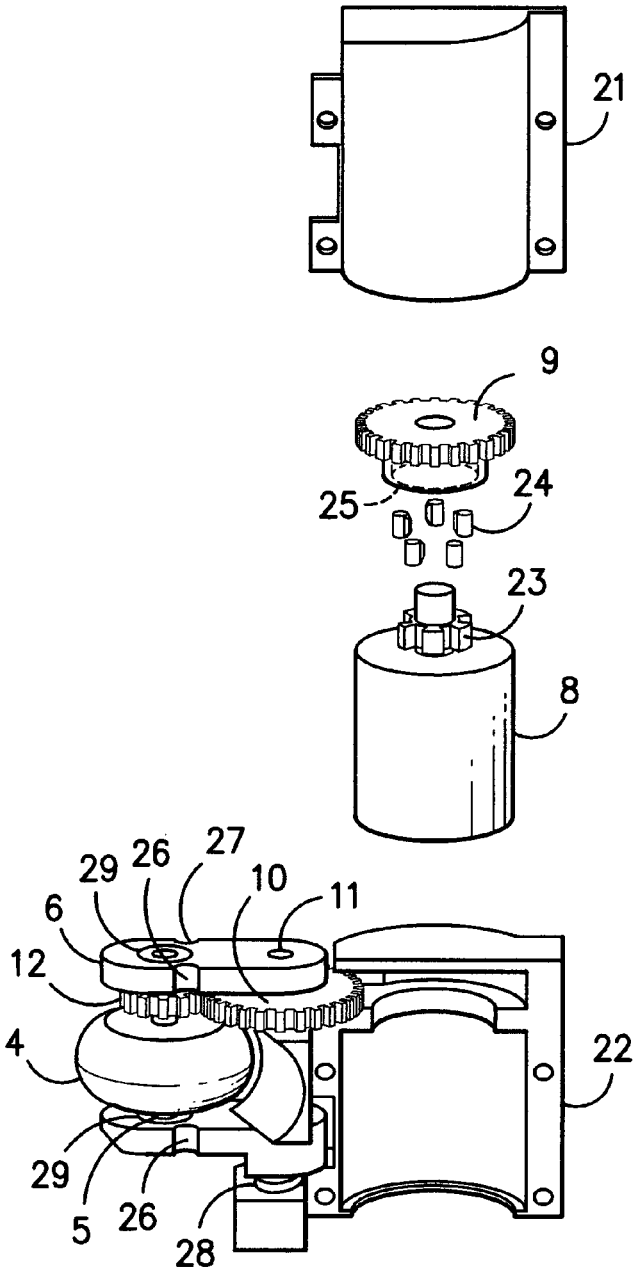
FIG. 2 is an exploded, perspective view of the rear wheel and motor assemblies.

Rear wheel 4 is mounted on axle 5, which is in turn supported by carriage 6, as shown in FIGS. 1 and 2. Carriage 6 is supported by and pivots relative to housing 7 of motor 8. Power is transferred from motor 8 to rear wheel 4 by a gear train having the following components. The gear train comprises an input gear 9, which is directly driven by motor 8, idler gear 10 and output gear 12. Idler gear 10 is mounted on idler gear shaft 11, which forms part of the hinge allowing carriage 6 to pivot relative to housing 7. Output gear 12 is mounted on rear axle 5. The ratios of the gears in the gear train can be selected to provide the desired torque and wheel speed, for a particular wheel and motor combination.

The front wheel 13 is mounted on front axle 14, which is supported by fork 15. Front wheel 13 is not powered, in the embodiment shown. Fork 15 pivots on shaft 16. Front wheel 13 is shown in the retracted position in FIG. 1.

Sole 2 of shoe 1 has rear recess 17 and front recess 18, to allow rear wheel 4 and front wheel 13 to pivot to a retracted position, respectively. When the wheels are in a retracted position, they do not extend below the lower surface of sole 2.

FIG. 2 is an exploded view of the rear wheel assembly, motor assembly and gear train. The housing 7 of motor 8 is comprised of two mated parts, identified as housing sections 21 and 22. Housing section 21 may be affixed to the sole 2 of shoe 1, for example by being bolted to sole 2, or sole 2 could be molded with housing section 21 in place. Housing sections 21 and 22 may be secured together by bolts, snap fit, interlocking tabs and slots, or combination thereof. The two sections 21 and 22 of housing 7 can be disassembled to service motor 8. Further, the interior of housing 7 is designed to conform to the shape of motor 8 and maintains the orientation of motor 8 during operation.

The drive mechanism of the shoe includes the motor, gear train (or other means to transfer power to the wheel) and the rear wheel. The rear wheel is preferably allowed free overrun. In the embodiment shown in FIG. 2, a clutch is provided at the connection between hub 23 on the shaft of motor 8 and input gear 9. The clutch comprises rollers 24 that fit into grooves in hub 23. The hub and rollers are inserted into opening 25 of input gear 9. The portion of input gear 9 around opening 25 acts as the "ring" component of the clutch. Rollers 24 are jammed between hub 23 and the "ring" formed by opening 25 when hub 23 rotates in one direction, and rollers 24 retract, allowing free movement between hub 23 and input gear 9, when hub 23 rotates in an opposite direction.

Carriage 6 has notches 26 on its upper side and notches 27 on its lower side. The notches engage pins (shown in FIG. 4), which secure carriage 6 and rear wheel 4 in an extended or retracted position. Spring 28 extends carriage 6 when the pins are disengaged. When the user desires to retract carriage 6 and rear wheel 4, the pins can be disengaged while the rear wheel is pressed against the ground by downward force.

Rear axle 5 is supported on carriage 6 and allowed to rotate freely in bearings 29. In another embodiment of the invention, a one-way roller clutch or equivalent clutch could be provided between rear axle 5 and carriage 6.

The motor is a direct current powered (DC) electric motor. Preferably, the speed of the motor is adjustable. Examples of suitable motors include brushed, brushless and coreless electric motors. Those skilled in the art may select the appropriate motor to meet the requirements of the motor for the present application and to optimize performance. The desired performance characteristics include efficient conversion of energy, compact size, reliability and power output sufficient to propel the user on level surfaces and even gradual inclines. In one example, the electric motors typically found in cordless power tools may be used. Such motors typically operate on 6 to 24 volts of power.

Although not shown, it is also within the scope of the invention to provide multiple motors, linked together in a gear train or other means to transfer power to one or both of the wheels of the shoe. By way of example, two motors, each having a relatively small diameter, could replace a single motor. One advantage to using multiple motors is that smaller motors would be easier to mount in the sole of shoe, without having to increase the thickness of the sole to the same extent as would be necessary to mount a single, larger diameter motor.

Figure 3:
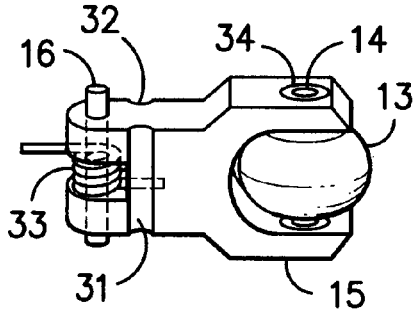
FIG. 3 is a perspective view of the front wheel assembly.

Referring to FIG. 3, a detailed view of the front wheel assembly is shown. Fork 15 has notch 31 on its upper side and notch 32 on its lower side. The notches engage pins (shown in FIG. 4) to secure front wheel 13 and fork 15 in an engaged or retracted position. Spring 33 urges front wheel 13 and fork 15 to an extended position when the pins are disengaged. When the user desires to retract front wheel 13, the pins can be disengaged while the front wheel is pressed against the ground by downward force.

Figure 4:
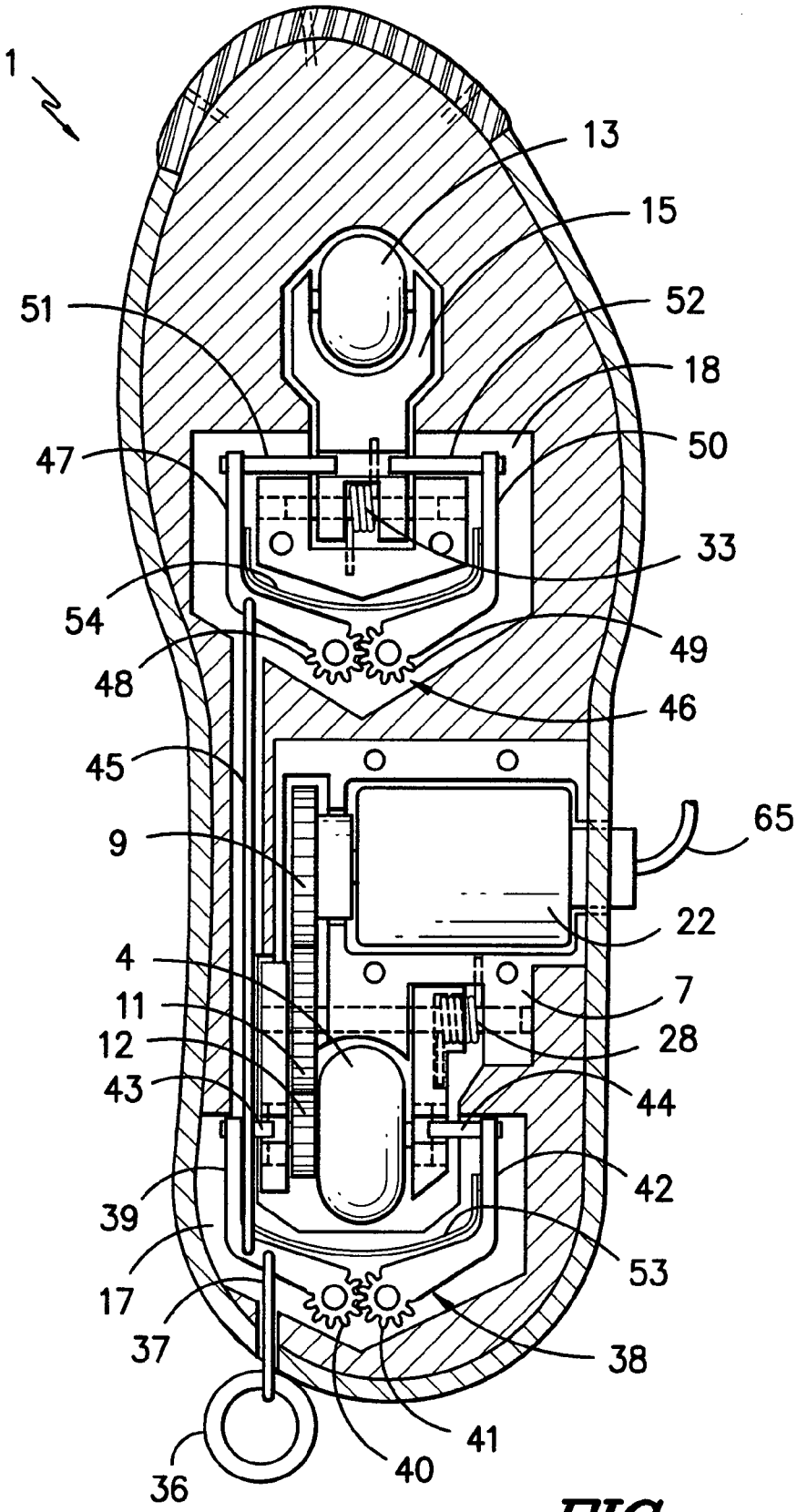
FIG. 4 is a cut-away view of the sole of the shoe, showing the front and rear wheel assemblies, motor assembly and the wheel release and latching mechanisms.

A cut-away view of sole 2 is show in FIG. 4. The front and rear wheels are secured in either an extended or retracted position by pins. The user can disengage the pins, when it is desirable to change the position of the wheels by pulling on ring 36, located in the heel of the shoe. Ring 36 is attached to cable 37, which is connected to arm 39 of rear wheel release mechanism 38. Arm 39 has toothed end 40, which engages toothed end 41 of arm 42. Arm 39 has pin 43 at an end opposite toothed end 40. Likewise, arm 42 has pin 44 at an end opposite toothed end 41. Pulling ring 36 draws arms 39 and 42 apart, and retracts pins 43 and 44, disengaging the pins from the notches in carriage 6. Spring clip 53 urges arms 39 and 42 together to secure the rear wheel in the desired orientation.

Wire 45 extends from arm 39 of the rear release mechanism 38 to arm 47 of front wheel release mechanism 46. Arm 47 has toothed end 48, which engages toothed end 49 of arm 50. Arm 47 has pin 51 at an end opposite toothed end 48. Likewise, arm 50 has pin 52 at an end opposite toothed end 49. Pulling ring 36 draws arms 47 and 50 apart, and retracts pins 51 and 52, disengaging the pins from the notches in fork 15 of the front wheel assembly. Spring clip 54 urges arms 47 and 50 together to secure the front wheel in the desired orientation.

A battery or battery pack is secured to the body of the skater, when the motorized shoe is in operation. The battery pack may be located in a position remote from the shoe. For example, the batteries may be supported by a belt, vest, shorts, back pack or "fanny pack" worn by the user. The batteries could even be incorporated into the soles of the shoe. The precise placement of the batteries is not critical to the operation of the invention. The battery pack can be easily removed and replaced with a charged battery pack, as necessary. Regardless of the placement of the batteries, the batteries are electrically connected to provide power to the motor, such as with an insulated wire.

The specification of the battery pack will vary depending upon the power requirements of the motor, and desired length of operation, before the battery pack is switched. By way of example, satisfactory results may be achieved with battery packs ranging in electrical potential of from 6 to 24 volts, preferably 9 to 18 volts, and having sufficient amperage capacity to operate the motor for a reasonable length of time. Examples of battery packs that may be employed in the present invention are the battery packs used in cordless power tools, such as cordless saws, drills and screwdrivers. Suitable batteries include nickel cadmium, nickel metal hydride and lithium ion batteries.

Figure 5:
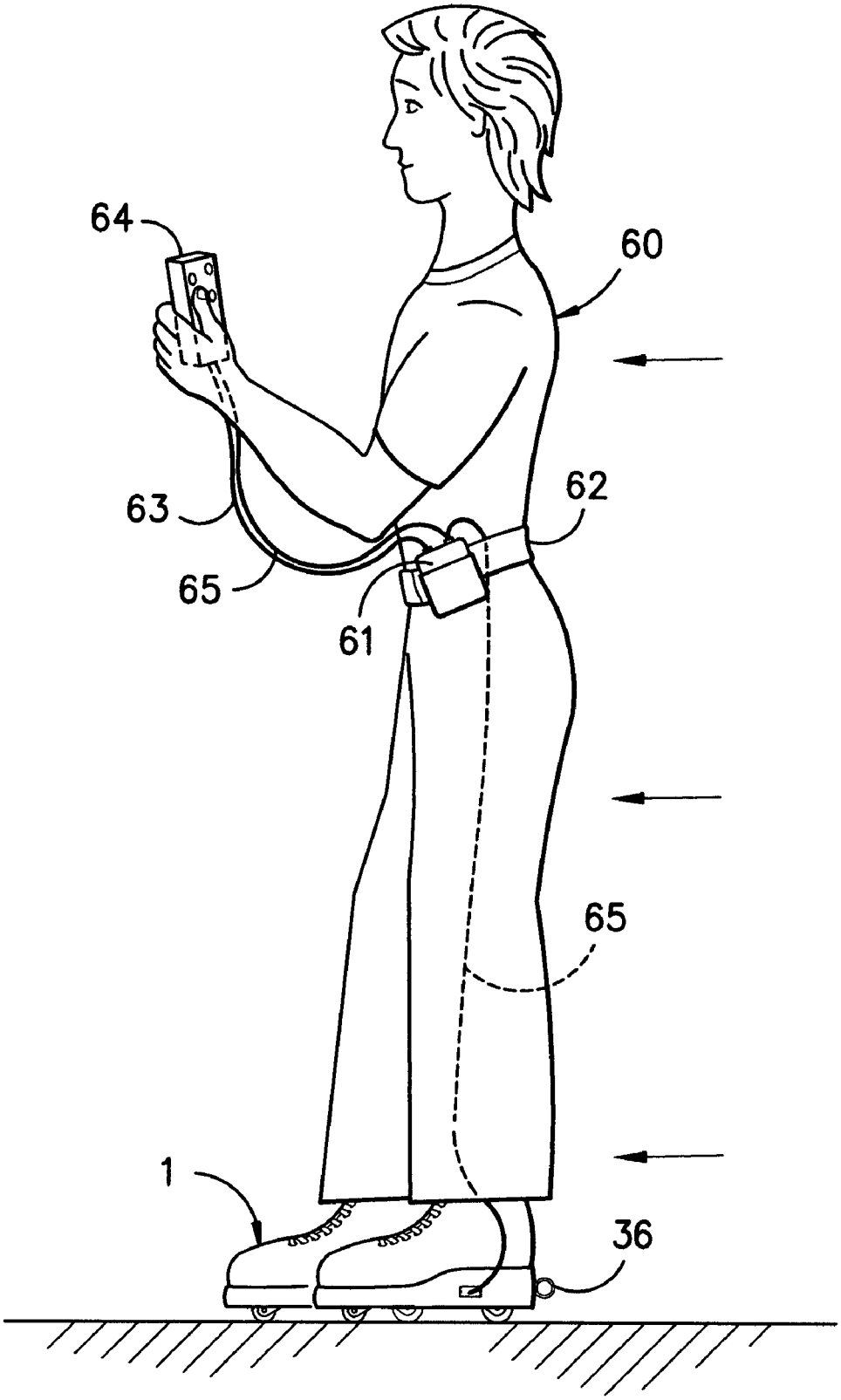
FIG. 5 is a side view of the motorized shoes, battery pack and throttle control being used in "skate" mode.

Referring to FIG. 5, user 60 is shown employing the shoes in "skate" or wheel extended mode. A battery pack 61 is held in belt 62, worn at the waist of user 60. The means to control the operation of the motor further includes a user interface, such as a hand operated throttle. Wire 63 provides the electrical connection between throttle 64 and battery pack 61. Examples of hand operated throttles are disclosed in U.S. Pat. Nos. 4,508,187 and 5,020,621. The throttle may be "hard wired" to control the current between the battery and the motor, or to control the operation of the motor. Also within the scope of the invention is a means to control the operation of the motor having a wireless connection, such as the electronic speed controllers used in conjunction with model airplanes.

In the embodiment shown in FIG. 5, electrical current flows from battery pack 61, through wire 63, to throttle 64 and back down wire 65 to motor 8 in shoe 1. If both first and second motorized shoes are provided, the motors of each shoe may be powered by the same battery pack and the same user interface (throttle) can be used to control both motors. A second wire (not shown) from the throttle to the second show provides electrical power to the motor.

In an embodiment of the invention employing first and second motorized shoes, a microprocessor can be employed to coordinate the speed of the two shoes. For example, a single user interface is employed, such as a hand held throttle, and the means to regulate the operation of the motors includes a microprocessor, which receives signals indicating the speed of each motor or wheel, compares the signals to each other and/or a set point, and controls the operation of each motor to propel the shoes at approximately the same speed. U.S. Pat. No. 6,059,062 discloses a microprocessor and system for controlling the speed of powered roller skates. Alternatively, separate user interfaces may be used to separately control the motors of the first and second shoes.

It can be understood that it is possible for a user to skate using the subject shoes, without power, as with conventional roller skates or roller blades. For example, the user can build up speed on the skates through physical exertion, and then activate the motor to coast at the desired speed.

If the user so desires, the wheels may be retracted by pulling ring 36 shown in FIG. 4, while exerting downward pressure on the wheels. With the wheels in retracted position, ring 36 is released and the wheels are securely latched. It will then be possible for the user to walk normally in the shoes, such as on stairs, grass or sand, where it would be impractical to skate.

The invention may be further understood by reference to the following claims.

What I claim is:

1. An article comprising:

(a) a shoe having a sole and an upper attached to the sole;

(b) a battery powered motor mounted on the shoe, wherein the motor has a shaft;

(c) a first wheel supported by a carriage mounted on the sole of the shoe, wherein the first wheel is movable from a retracted position within the sole of the shoe, to an extended position with a tread of the first wheel projecting below the sole of the shoe, whereby the carriage pivots relative to the motor;

(d) means to transmit power from the motor shaft to the first wheel, when the first wheel is in an extended position;

(e) a battery electrically connected to the motor; and (f) a throttle control in communication with the motor to allow a user to regulate the speed of the wheel.

2. The article of claim 1, wherein the means to transmit power is selected from the group consisting of a gear, belt, chain or flexible cable.

3. The article of claim 1, wherein the motor is mounted in the sole of the shoe and the motor does not extend below the sole of the shoe.

4. The article of claim 1, comprising a second wheel mounted on the sole of the shoe, wherein the second wheel is movable from a retracted position within the sole of the shoe, to an extended position with the tread of the second wheel projecting below the sole of the shoe, wherein the first and second wheels are mounted on separate axles.

5. The article of claim 1, wherein the first wheel is positioned to the rear of the motor.

6. The article of claim 4, wherein the first wheel is mounted in the rear of the sole of the shoe, and the second wheel is mounted in the front of the sole of the shoe.

7. The article of claim 4, further comprising (a) a second shoe having a sole and an upper attached to the sole;

(b) a third wheel mounted on the sole of the second shoe, wherein the third wheel is movable from a retracted position within the sole of the second shoe, to an extended position with a tread of the third wheel projecting below the sole of the second shoe;

(c) a fourth wheel mounted on the sole of the second shoe, wherein the fourth wheel is movable from a retracted position within the sole of the fourth shoe, to an extended position with the tread of the fourth wheel projecting below the sole of the first shoe; and (d) a second battery powered motor mounted on the sole of the second shoe and positioned to engage the third wheel, when the third wheel is in an extended position.

8. The article of claim 6, wherein the first wheel is positioned to the rear of the motor.

9. The article of claim 8, wherein the first wheel is held in a retracted or an extended position by a first latching mechanism mounted on the sole of the shoe, and the second wheel is held in a retracted or an extended position by a second latching mechanism mounted on the sole of the shoe, and further comprising a cable connected to the first and second latching mechanisms, whereby a user can disengage the first and second latching mechanisms by applying tension to the cable.

10. The article of claim 5, wherein the motor is mounted in a housing in the sole of the shoe and the housing holds the motor in place.

11. An article comprising:

(a) a shoe having a sole and an upper attached to the sole;

(b) a battery powered motor mounted on the sole of the shoe, wherein the motor has a shaft;

(c) a first wheel mounted on the sole of the shoe, wherein the first wheel is movable from a retracted position within the sole of the shoe, to an extended position with a tread of the first wheel projecting below the sole of the shoe, wherein the first wheel is positioned to the rear of the motor;

(d) means to transmit power from the motor shaft to the first wheel, when the first wheel is in an extended position;

(e) a battery electrically connected to the motor; and (f) a throttle control in communication with the motor to allow a user to regulate the speed of the wheel.

12. The article of claim 11, wherein the means to transmit power is selected from the group consisting of a gear, belt, chain or flexible cable.

13. The article of claim 11, wherein the motor does not extend below the sole of the shoe.

14. The article of claim 11, comprising a second wheel mounted on the sole of the shoe, wherein the second wheel is movable from a retracted position within the sole of the shoe, to an extended position with the tread of the second wheel projecting below the sole of the shoe, wherein the first and second wheels are mounted on separate axles.

15. The article of claim 11, wherein the motor is mounted in a housing in the sole of the shoe and the housing holds the motor in place.

16. The article of claim 14, wherein the first wheel is mounted in the rear of the sole of the shoe, and the second wheel is mounted in the front of the sole of the shoe.

17. The article of claim 14, further comprising (a) a second shoe having a sole and an upper attached to the sole;

(b) a third wheel mounted on the sole of the second shoe, wherein the third wheel is movable from a retracted position within the sole of the second shoe, to an extended position with a tread of the third wheel projecting below the sole of the second shoe;

(c) a fourth wheel mounted on the sole of the second shoe, wherein the fourth wheel is movable from a retracted position within the sole of the fourth shoe, to an extended position with the tread of the fourth wheel projecting below the sole of the first shoe; and (d) a second battery powered motor mounted on the sole of the second shoe and positioned to engage the third wheel, when the third wheel is in an extended position.

18. The article of claim 16, wherein the first wheel pivots relative to the motor when the first wheel is moved to an extended position.

19. The article of claim 18, wherein the first wheel is held in a retracted or an extended position by a first latching mechanism mounted on the sole of the shoe, and the second wheel is held in a retracted or an extended position by a second latching mechanism mounted on the sole of the shoe, and further comprising a cable connected to the first and second latching mechanisms, whereby a user can disengage the first and second latching mechanisms by applying tension to the cable.

20. The article of claim 19, wherein the motor is mounted in a housing in the sole of the shoe and the housing holds the motor in place.

* * * * *